US008794302B2

(12) United States Patent
Schneider et al.

(10) Patent No.: US 8,794,302 B2
(45) Date of Patent: Aug. 5, 2014

(54) NUBBED U-BEND TUBE SUPPORT

(71) Applicant: Babcock & Wilcox Canada Ltd., Cambridge (CA)

(72) Inventors: William G. Schneider, Branchton (CA); Brian Pearce, Cambridge (CA); Nicholas Idvorian, Kitchener (CA); Stephen W. Ziegler, Cambridge (CA); Peter A. Caple, Cambridge (CA)

(73) Assignee: Babcock & Wilcox Canada Ltd., Cambridge, Ontario (CA)

( * ) Notice: Subject to any disclaimer, the term of this patent is extended or adjusted under 35 U.S.C. 154(b) by 0 days.

(21) Appl. No.: 14/182,957

(22) Filed: Feb. 18, 2014

(65) Prior Publication Data

US 2014/0158835 A1 Jun. 12, 2014

Related U.S. Application Data

(62) Division of application No. 11/779,653, filed on Jul. 18, 2007, now Pat. No. 8,695,688.

(51) Int. Cl.

| | |
|---|---|
| ***F28F 9/00*** | (2006.01) |
| ***F28F 9/013*** | (2006.01) |
| ***F28D 7/06*** | (2006.01) |

(52) U.S. Cl.

CPC ..... *F28D 7/06* (2013.01); *F28F 9/0132* (2013.01); *F28F 9/013* (2013.01)

USPC ..... 165/162; 122/510

(58) Field of Classification Search

USPC ..... 248/68.1; 122/510; 165/69, 76, 162, 165/178

See application file for complete search history.

(56) References Cited

U.S. PATENT DOCUMENTS

| | | | |
|---|---|---|---|
| 4,318,528 | A | 3/1982 | Dobson |
| 4,579,310 | A | 4/1986 | Wells et al. |
| 4,705,244 | A | 11/1987 | Saotome et al. |
| 6,772,832 | B2 | 8/2004 | Schneider |
| 7,438,265 | B2 | 10/2008 | Urzua |
| 7,712,709 | B2 | 5/2010 | Winchester |
| 8,020,259 | B2 | 9/2011 | Ho et al. |
| 2003/0196786 | A1 | 10/2003 | Schneider |
| 2010/0258685 | A1 | 10/2010 | Gardner et al. |

FOREIGN PATENT DOCUMENTS

| | | | |
|---|---|---|---|
| JP | 05-022395 | Y | 3/1993 |
| JP | 05-071683 | Y | 9/1993 |
| JP | 2009-512833 | A | 3/2009 |

OTHER PUBLICATIONS

Notice on the First Office Action from the State Intellectual Property Office of the People's Republic of China dated Feb. 10, 2011.

Notice on the Second Office Action from the State Intellectual Property Office of The People's Republic of China dated Mar. 20, 2012.

Notice of Reason(s) for Rejection from the Japanese Patent Office dated Nov. 6, 2012.

*Primary Examiner* — Gwendolyn W Baxter

(74) *Attorney, Agent, or Firm* — Eric Marich; Christopher L. Smith

(57) ABSTRACT

A self-supporting system for positioning and restraining the U-bend tubes in the U-bend region of a nuclear steam generator includes arrays incorporating unique support bars having nubs projecting in the out-of-plane direction of the tube planes. The system also includes assemblies for spacing the arrays, tie bars to prevent the arrays from splaying and saddle bar assemblies to support the outermost tube layers. The system provides positive restraint to nub engaged tubes in both the in-plane direction of the tube planes and the out-of-plane direction.

27 Claims, 13 Drawing Sheets

NUBBED U-BEND TUBE SUPPORT

PRIORITY CLAIM

This application is a divisional of U.S. patent application Ser. No. 11/779,653, filed Jul. 18, 2007. The disclosure of this application is hereby incorporated by reference in its entirety.

FIELD AND BACKGROUND OF INVENTION

The present invention relates generally to the field of heat exchanger tube supports, and in particular to a new and useful U-bend support system for positioning and restraining the U-bends of water tubes within a nuclear steam generator against flow-induced vibration.

In a pressurized water nuclear power station, steam generators, which are large heat exchangers, transfer heat produced via nuclear reactions in the reactor core, from a primary water coolant to a secondary water coolant that drives the steam turbine. The primary coolant is pressurized, which allows the primary water coolant to be heated in the reactor core with little or no boiling. For example, in a light water reactor, the primary coolant is pressurized to about 2250 psia and heated to about 600 deg F. in the reactor core. From the reactor, the primary water coolant flows to a steam generator, where it transfers heat to the secondary coolant. In a U-tube, or recirculating steam generator, the primary coolant enters at the bottom of the steam generator, flows through tubes having an inverted U-shape transferring heat to the secondary coolant, and then exits at the bottom of the steam generator. The secondary coolant is pressurized only to a pressure below that of the primary side, and boils as it flows along the outside of the tubes, thereby producing the steam needed to drive the turbine. Nuclear steam generators must be capable of handling large quantities of two-phase secondary coolant moving at high flow rates, and are therefore very large structures. For example, a nuclear U-tube steam generator can weigh more than 450 tons, with a diameter exceeding 12 feet and an overall length of greater than 70 feet. It may contain as many as 9,000 or more of the long, small diameter, thin-walled U-shaped tubes. For a general description of the characteristics of nuclear steam generators, the reader is referred to Chapters 46, 48 and 50 of *Steam/Its Generation and Use,* 41st Edition, The Babcock & Wilcox Company, Barberton, Ohio, U.S.A., ©2005, the text of which is hereby incorporated by reference as though fully set forth herein.

Nuclear steam generators require tube restraints or supports, to position the tubes and to restrain the tubes against flow induced vibration forces. In the U-bend region of a nuclear steam generator, a large flow of steam and water mixture passes upwards through the tube array, in a general direction which locally is normal to the axis of the individual U-bend tubes. This large two phase flow is able to cause excitation of the U-bend tubes via the turbulent and other flow forces imparted by the flow. As a result, the tubes tend to vibrate in both the out-of-plane and in-plane directions relative to the U-bend plane. Typically this restraint function is provided by an array of flat U-bend support bars. While such flat bars provide positive restraint in the U-bend out-of-plane direction, they provide restraint only by friction in the in-plane direction.

One known type of nuclear steam generator U-bend support assembly, depicted in FIG. 1, and in greater detail in FIG. 2, is manufactured by Babcock & Wilcox Canada Ltd. FIG. 1 shows a nuclear steam generator 80 having a plurality of U-bend tubes 102, referred to as a tube bundle, which are fixed at their ends to a heavy tubesheet 90. The U-bend tubes

102 are arranged in layers or columns. Each layer or column incorporates a set of tubes of successively larger radius, which are nested, from innermost tube to outermost tube, to create the layer or column of tubes in the particular plane. The tubes are further arranged in rows, with each row containing all tubes of a particular U-bend radius. For purposes of illustration, however, FIG. 1 shows only a limited number of U-bend tubes 102, and FIG. 2 shows only the outermost tubes of the center U-bend layers. The straight leg portions of the U-bend tubes 102 are supported at several locations by vertically spaced apart tube support plates 120 as shown in FIG. 1.

The U-bend portions 103 of tubes 102 extend beyond the uppermost tube support lattice (or plate) 124 and sweep through 180 degrees of arc. The relatively long U-bend region 103 of each U-tube 102 requires supports to keep them in position and to restrain against flow-induced vibration (FIV) excitation due to the very large upward flow of two-phase steam/water mixture.

As shown in FIG. 1, and in greater detail in FIG. 2, the U-bend tubes 102 are positioned and restrained in the U-bend region 103 of U-bend tubes 102 by a U-bend support assembly 100, which includes a number of U-bend support bar arrays 180. Each U-bend support bar array 180 is comprised of flat U-bend support bars 160, which are positioned in sets between layers of tubes within the U-bend region of the steam generator.

As shown in FIG. 2, the flat U-bend support bars 160 fan out from the center of the U-bend such that individual bar sets are assembled into a U-bend support bar array 180, or "fan" bar array, in which the inner ends of the individual bars are interconnected to collector bar 114 by a mechanical or welded joint 190. U-bend support bar array 180 is referred to as a "half-fan" array, since collector bar 114 covers only half the U-bend region (i.e. either the cold leg or the hot leg) of tubes in a particular plane.

Each U-bend support bar array 180 incorporates about 4 to 12 of the flat U-bend support bars 160. The flat U-bend support bars 160 are positioned so as to provide support to the U-bend tubes 102 at certain points along the arc of each U-bend tube in the array. The angular separation of the flat U-bend support bars 160 depends upon the U-bend size and flow conditions; the flat U-bend support bars 160 are located to minimize unsupported tube lengths. The individual flat U-bend support bars 160 are typically made of stainless steel, and are about 1" to 1.5" wide and about 0.1" to 0.2" thick. A U-bend support assembly 100 may incorporate between about 100 to about 200 of the fan-shaped U-bend support bar arrays 180, with one such array located between each plane of U-bend tubes.

The outer ends of the flat U-bend support bars 160 are collected, restrained and supported by arch bar support structures, which extend in the out-of-plane direction, perpendicular to the columns or layers of U-bend tubes 102. Each arch bar structure is made up of arch bars 170 and clamping bars 175. Each arch bar 170 is a single continuous piece. The clamping bars 175 are segmented and affix the J-tabs 176 and the upper ends of the flat U-bend support bars 160 to arch bars 170. Each arch bar support structure positions the flat U-bend support bars 160 of a U-bend support bar array 180, carrying the weight of the bars and redistributing the weight of the U-bend support assembly 100 back to the peripheral U-bend tubes via J-tabs 176. Tie tubes 150, arranged horizontally above arch bars 170 and interconnecting the arch bar support structures at selected locations, restrain the fan bar arrays in position on the U-bends.

The U-bend support bar arrays 180 position the planes of U-bend tubes 102 in space, and most importantly, restrain the individual U-bend tubes against flow induced vibration. Restraint against out-of-plane motion is provided by the physical presence of the flat U-bend support bars 160, which are situated immediately adjacent to the U-bend tubes 102. The bar-to-tube clearance is purposely quite small, with individual bar-to-tube diametral clearances varying from about 0 to 0.010" or more. The flat U-bend support bars 160, with their small bar-to-tube clearances, thus prevent significant motion of the tubes in the out-of-plane direction 140. In the in-plane direction 130, however, the U-bend tubes 102 are not positively restrained, but instead depend solely upon friction between the U-bend tubes 102 and the flat U-bend support bars 160 to restrict and dampen the flow induced motion of the tubes in their in-plane direction. Depending on the design details and flow conditions, the effect of the friction in providing in-plane restraint may not be fully adequate in providing effective in-plane restraint.

U.S. Pat. No. 6,772,832, which is assigned to the assignee of the present invention, discloses a corrective retrofit tube support structure having rows of concave pockets located on diagonally opposite surfaces of the bar.

SUMMARY OF INVENTION

The present invention is drawn to an improved U-bend tube support system which is particularly suited for the U-bend region of a U-tube nuclear steam generator. The system includes arrays of unique support bars having nubs projecting in the out-of-plane direction of the tube planes. The system also includes assemblies for spacing the arrays, tie bars to prevent the arrays from splaying and saddle bar assemblies to support the outermost tube layers.

The system of the present invention positions the U-bend region of the U-tubes and provides positive restraint in both the in-plane and out-of-plane directions. The system advantageously is self-supporting, requiring no additional structure or external restraints, and provides improved access for maintenance and repair.

Accordingly, one aspect of the invention is drawn to a support bar for supporting the U-bend region of U-tubes in a nuclear steam generator comprised of an elongated body having a plurality of nubs projecting in the out-of-plane direction, from at least one side of the body.

Another aspect of the invention is drawn to a nubbed support bar array for supporting the U-bend region of U-tubes in a nuclear steam generator. The nubbed support bar array includes a plurality of flat elongated bars, and a plurality of nubbed support bars. Each nubbed bar is an elongated body with a plurality of nubs projecting in the out-of-plane direction from at least one side of the body. The nubbed bar may include an integral spacer block.

Yet another aspect of the invention is drawn to a support bar assembly for supporting the U-bend region of U-tubes in a nuclear steam generator. The assembly includes a plurality of nubbed support bar arrays with nubbed bar arrays arranged between adjacent layers of U-tubes. The nubbed support bar arrays include a plurality of flat elongated bars, a plurality of nubbed support bars, a generally flat elongated connector bar connected to the inner ends of the plurality of flat elongated bars and directly or indirectly connected to the inner ends of the plurality of nubbed support bars. The connector bar extends across both the hot leg and the cold leg of the associated tube layer. Each nubbed bar is an elongated body with a plurality of nubs projecting in the out-of-plane direction, from at least one side. Each nub has a generally rectangular longitudinal cross-section and tube contact faces generally parallel to the intrados or extrados of the U-tubes. The assembly also includes spacer blocks or spacer clips for spacing the outer bar ends in the out of plane direction, and arcuate tie bars for spacing each nubbed support bar array in the in-plane direction. Each tie bar is spaced in parallel with the extrados of the outermost tube of an associated tube layer, and has an out-of-plane thickness about twice the cross-sectional radius of the U-tubes.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
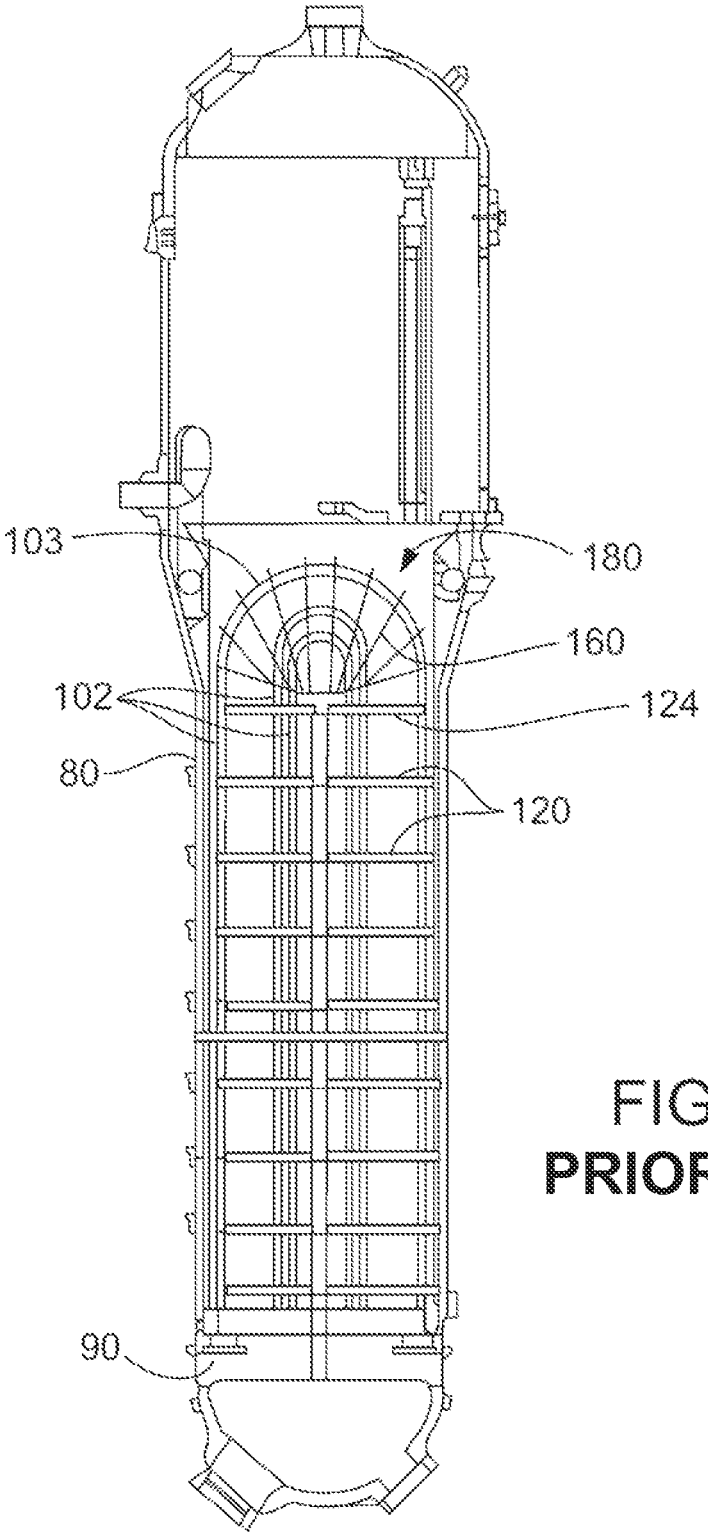
FIG. 1 PRIOR ART
FIG. 1 is a schematic view of a nuclear steam generator having U-bend heat exchanger tubes.
Figure 2:
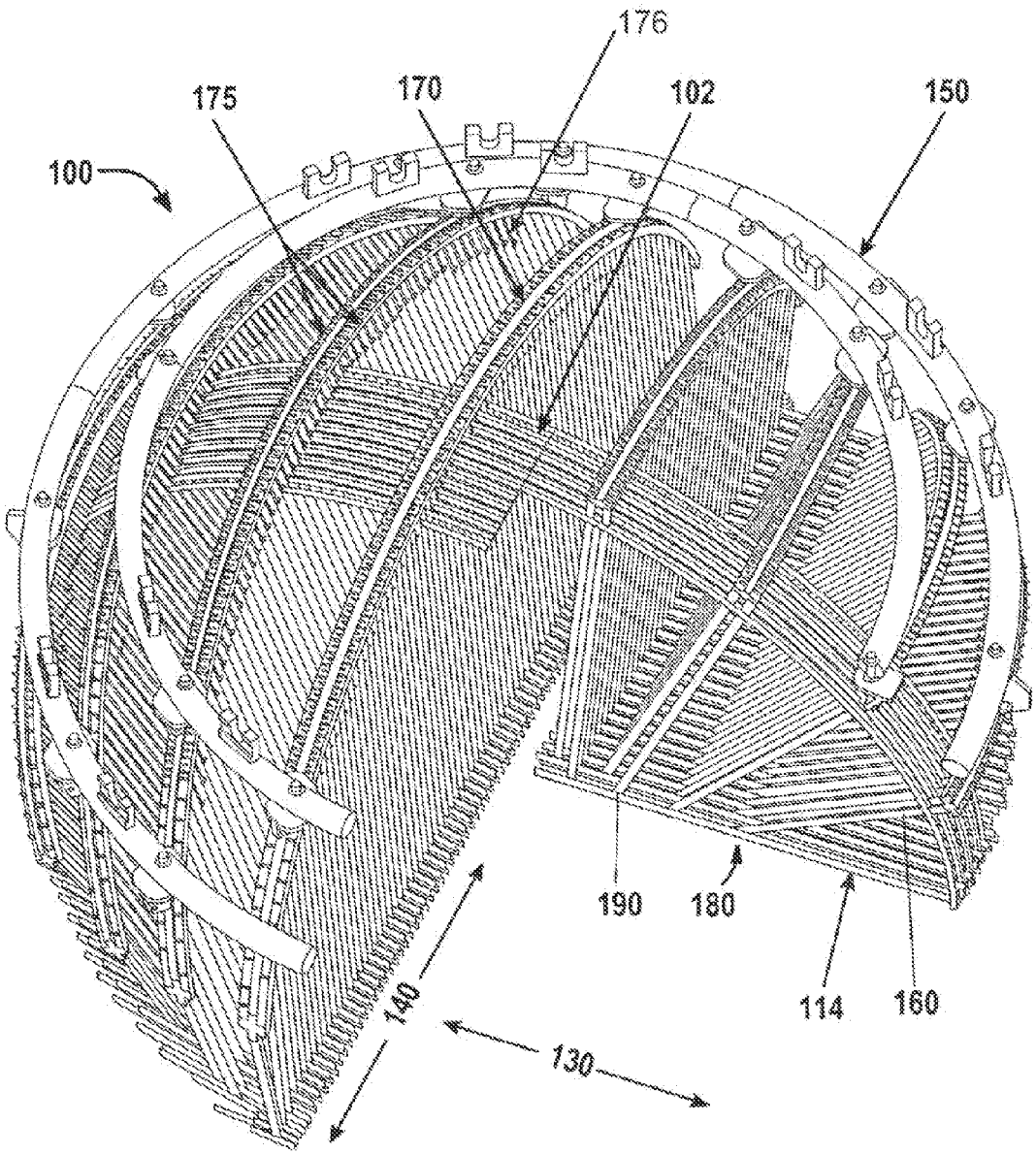
FIG. 2 PRIOR ART
FIG. 2 is a partially cut away perspective view of a known U-bend support assembly.
Figure 3:
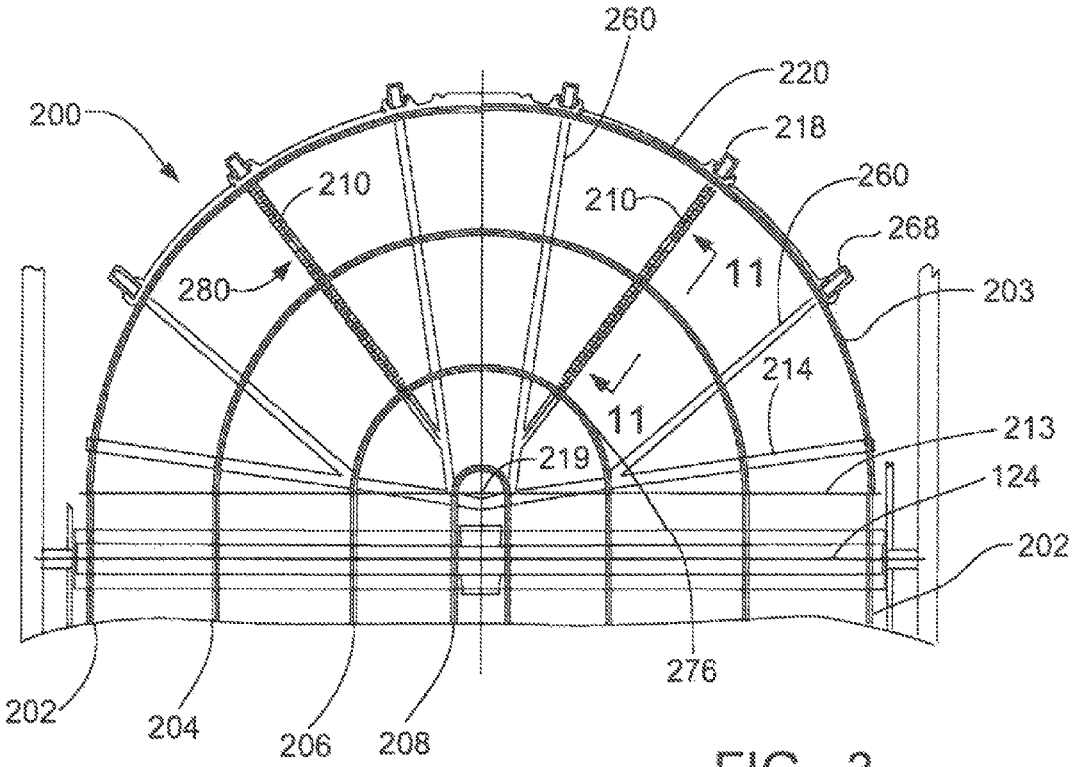
FIG. 3 is a sectional front elevation view of an improved U-bend tube support system of the present invention.
Figure 4:
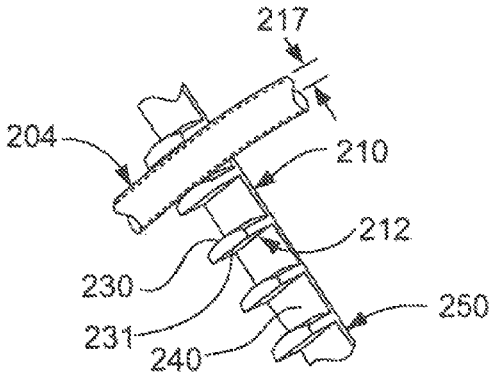
FIG. 4 is a partial perspective view of a nubbed support bar employed in the present invention according to a first embodiment.

Referring to the drawings in which reference numbers are used to refer to the same or functionally similar elements, FIGS. 3 and 4 depict the improved U-bend support assembly 200 of the present invention, for use in a U-tube nuclear steam generator, which incorporates nubbed fan bars 210 arranged in nubbed fan bar arrays 280.

Nubbed fan bar array 280 is a welded array of nubbed fan bars 210 and flat elongated bars 260, running upward from collector bar 214.

Each nubbed fan bar 210 is an elongated body having multiple "nubs" 212, which project from a flat face or side 240 of nubbed fan bar 210 and have a generally rectangular longitudinal cross section. Nubs 212 may be machined or otherwise created on a face 240 of nubbed fan bar 210, down to a nub-initiation radius 276, the radius above which the bar 210 incorporates nubs 212, a radius which is typically about 30% of the largest tube radius of curvature. The reverse face 250, opposite face 240 of nubbed fan bar 210, is typically flat, but may also have nubs.

Nubs 212 typically fill the radial spaces between successive tubes (e.g. tubes 202, 204, 206 within a particular tube column 203), with provision for assembly clearance. Nubs 212 project in the out-of-plane direction (perpendicular to the flat face 240) for a distance greater than the cross-sectional radius 217 of the tubes in the adjacent tube column 203. The tube contact faces 230, 231 of nub 212 are thus perpendicular to the U-bend in-plane direction (defined by a tube column such as tube column 203). Tube contact faces 230, 231 preferably of convex and flat or concave shape respectively are relatively parallel to the tube intrados and extrados, respectively (but relieved to avoid the possibility of tube distress from the nub corners.)

Nubbed fan bars 210 are preferably arranged in opposing pairs having a radial orientation with respect to the center of curvature 219 of the U-bend of the tubes of a tube column or layer such as tube column 203.

As shown in FIG. 3, the inner ends of flat fan bars 260 are welded to collector bar 214, which runs generally horizontally across the inner ends of fan bars 260. The inner ends of nubbed fan bar 210 are likewise affixed by welding, directly or indirectly, to collector bar 214. Bars 210, 214, and 260 are arranged as even numbers of bars, typically from about 4 to about 12 bars total. Collector bar 214 is preferably made up of two elongated flat bars welded together. Collector bar 214 of nubbed fan bar array 280 runs across all the tubes of the entire tube layer or column 203, i.e. from the outermost hot leg tube to the outermost cold leg tube, so that nubbed fan bar array 280 is a full fan bar array covering the entire U-bend region of tubes in a particular column 203.

Where employed, nubs 212 provide in-plane tube restraint against flow-induced vibration excitation. Nub coverage for nubbed fan bars 210 with nubs 212 may extend from the outer surface of outermost tube 202 of a particular tube layer and down to a tube at some nub-initiation radius 276. The nub-initiation radius 206 276 is selected to provide in-plane restraint coverage to the smallest possible radius, without encountering excessive tube stress due to in-plane nub-induced constraint related to differential tube-to-tube motion within the particular tube layer. Nubs 212 of each nubbed fan bar 210 preferably extend over a range from just beyond the outermost tube of a tube column or layer (e.g. tube 202) down to a nub-initiation radius (e.g. tube 206) to cover approximately the outer 70% of the maximum tube bundle radius, i.e. the largest tube radius of curvature in the U-bend region.

Referring now to FIGS. 6A thru 6E, the outer ends 218, 268 of fan bars 210, 260 are preferably interconnected and spaced in the out-of-plane direction by a system of spacer block assemblies 400 comprised of spacer blocks 405, studs 402, retention pins 430, nuts 404 and nut locking features. Collector bars 214 preferably have no spacer assemblies 400.

Spacer block assemblies 400 include spacer blocks 405 having a thickness preferably exactly equal to the tube out-of-plane pitch, i.e. the distance between adjacent tube planes 209. Studs 402 interconnect the spacer blocks 405. The tips or ends 218, 268 of fan bars 210, 260 are positioned within a slot 407 in the back face of each spacer block 405, and engage the stud 402 passing through one or more drilled holes 215, 216 near bar ends 218, 268 and through aligned holes 415, 416 in the adjacent spacer block 405.

Figure 6A:
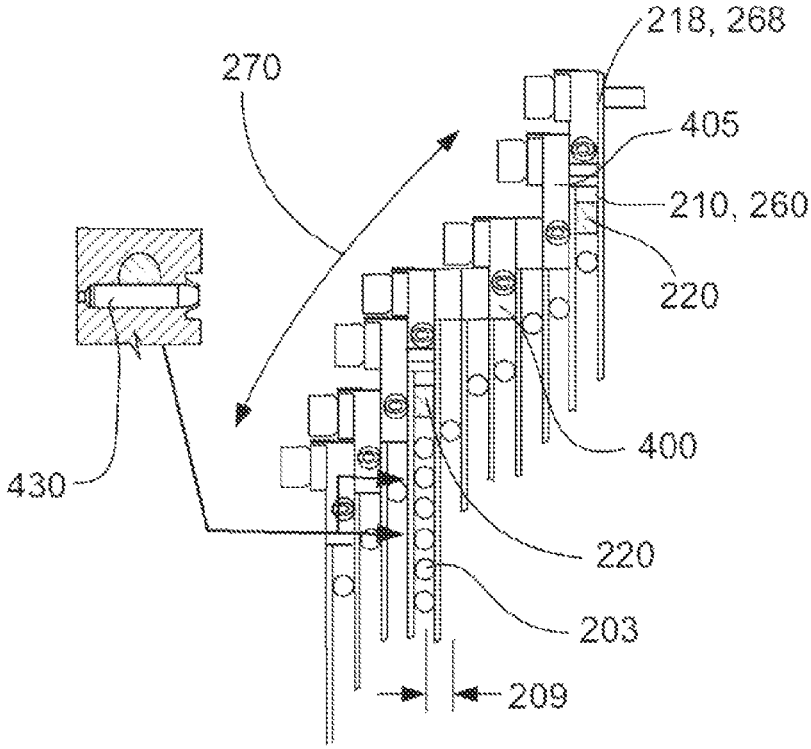
FIG. 6A is a partial sectional elevation view of a spacer assembly suitable for use in the present invention.
Figure 6B:
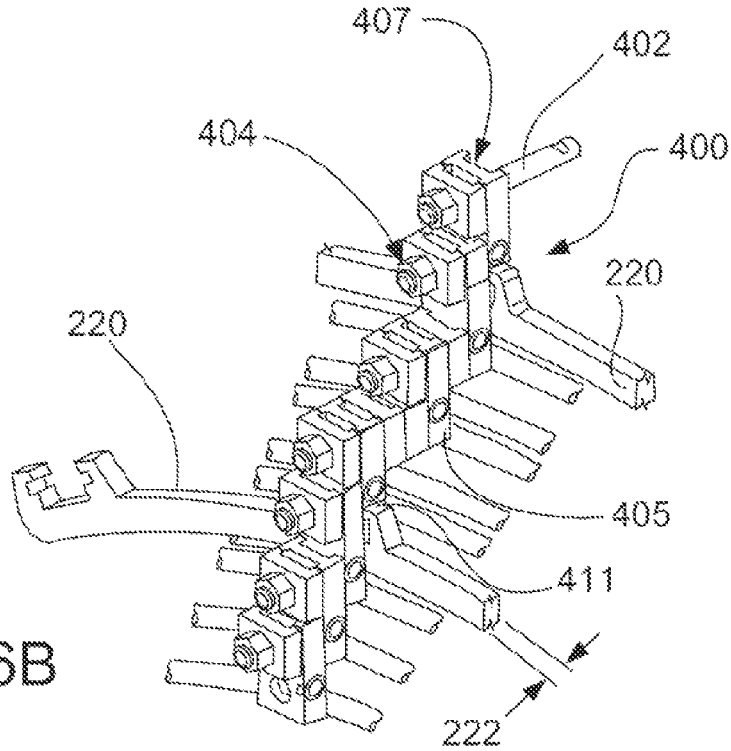
FIG. 6B is a partial perspective view of a spacer assembly suitable for use in the present invention.

As shown in FIG. 6A, spacer blocks 405 form a plurality of built-up arch assemblies 270 over the top of the tube bundle at the locations of the fan bar ends 218, 268.

Spacer block assemblies 400 are preferably designed to allow a progressive bottom to top (bundle and U-bend plane horizontal) assembly process, i.e. spacer blocks 405 are of similar shape and the same orientation throughout (and are not symmetrical about the center plane.)

Figure 5A:
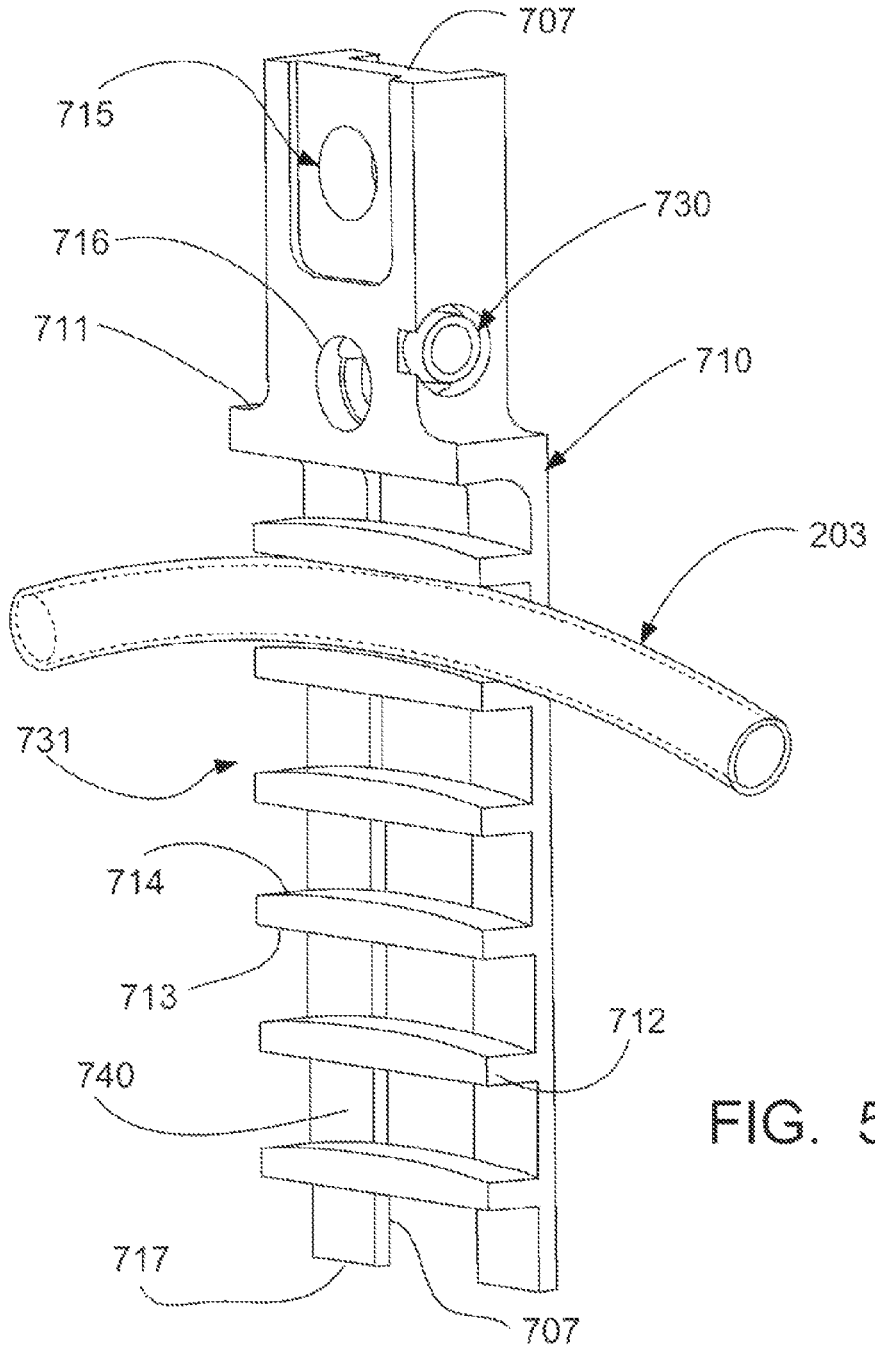
FIG. 5A is a partial perspective view of a nubbed support bar employed in the present invention according to a second embodiment.
Figure 7:
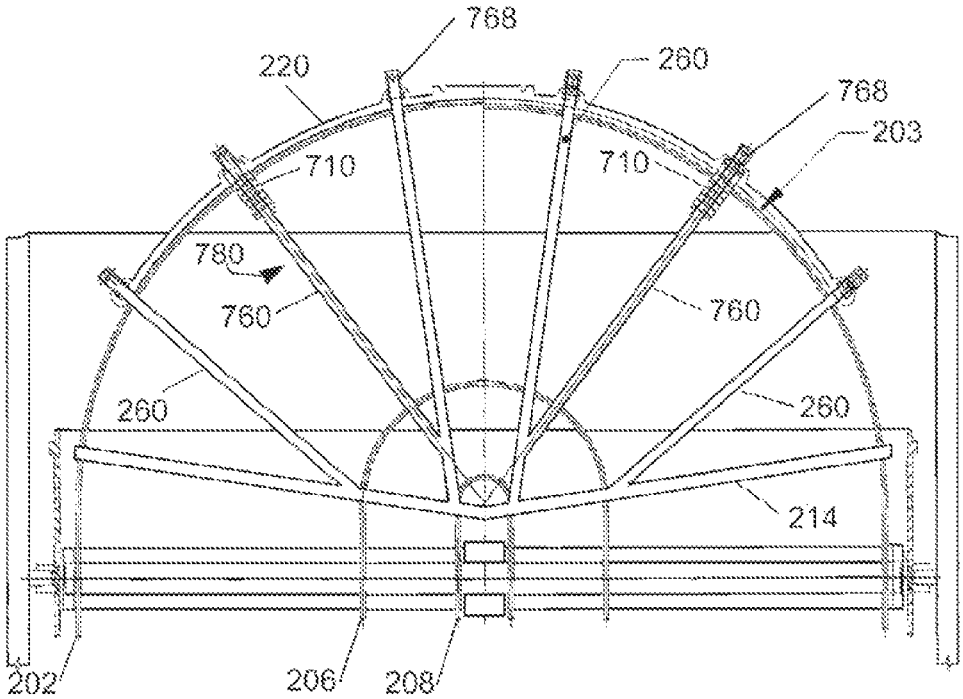
FIG. 7 is a sectional elevation view showing elements of an improved U-bend tube support bar array of the present invention according to a second embodiment.
Figure 8:
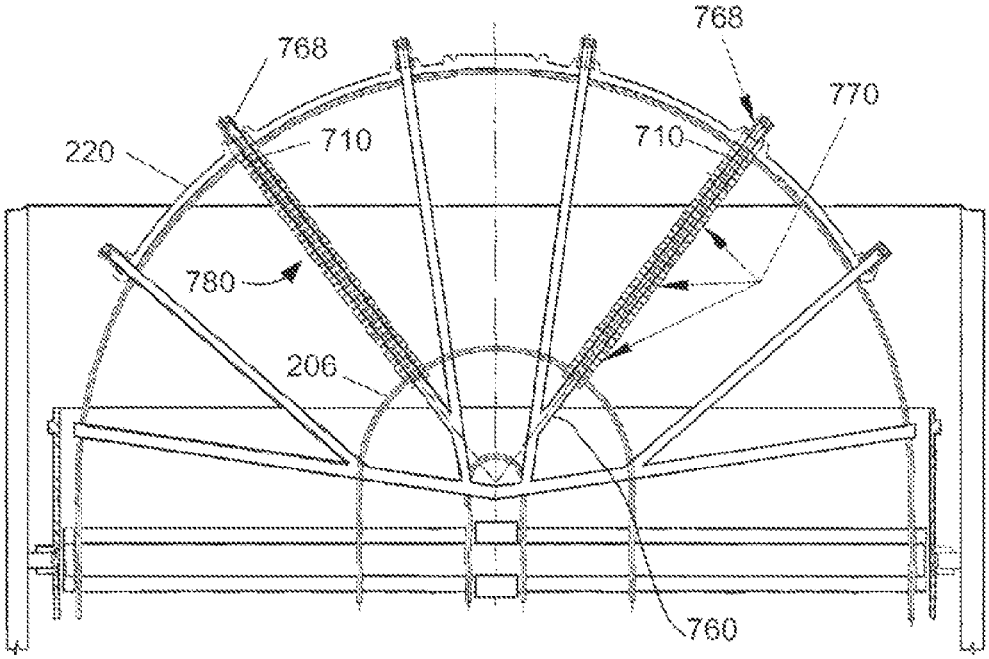
FIG. 8 is a sectional elevation view of an improved U-bend tube support bar array of the present invention according to a second embodiment.

In an alternate embodiment, shown in FIGS. 5A, 7 and 8, ladder-block nubbed bar 710 may be used in place of the nubbed fan bar 210 and spacer block 405 combination of nubbed fan bar array 280, to form a nubbed ladder-block fan bar array 780.

Ladder-block nubbed bar 710 has a flat fan bar 760 and, similar to spacer block 405, has a slot or channel 707 on its back face to engage flat fan bar 760. Slot 707 is sized so that block assembly stack build up is block-to-block; i.e. the fan bar 760 has a slight clearance within slot 707 to ensure that stack-up is block-to-block and not block-to-bar-to-block. The block portion of nubbed ladder-block 710 preferably has all of the features of spacer block 405 including one or two stud holes (715, 716), stud retention pin hole 730, etc.

Nubbed ladder-block 710 has nubs 712 on ladder rails 740 which engage the U-bend regions of U-tubes 203. As shown in FIG. 7, nubbed ladder-blocks 710 are preferably positioned at the outer ends 768 of pairs of radially oriented flat fan bars 760, so as to engage the U-tubes in the U-bend region 203. Regular spacer blocks 405 are preferably used at other, unnubbed bar locations 260. After positioning the tubes 203 and the nubbed ladder-blocks 710 and spacers 405 during assembly, the fan bar array 780 for that tube column is next placed on top of the tubes 203, nubbed ladder-blocks 710 and spacers 405.

Where nubbed ladder-block bars 710 are used in place of nubbed bars 210, the inner extent of nub coverage is limited by the length of the ladder rails 740 of nubbed ladder block 710. That leaves tubes in the region between the nub-initiation radius 276 and the inner end 717 of nubbed ladder block 710 without in-plane restraint. As shown in FIG. 8, in-plane restraint is provided for such regions by nubbed ladder extensions 770. The combination of nubbed ladder-blocks 710 and nubbed ladder extensions 770 thus provides nub coverage along the desired length.

Figure 5B:
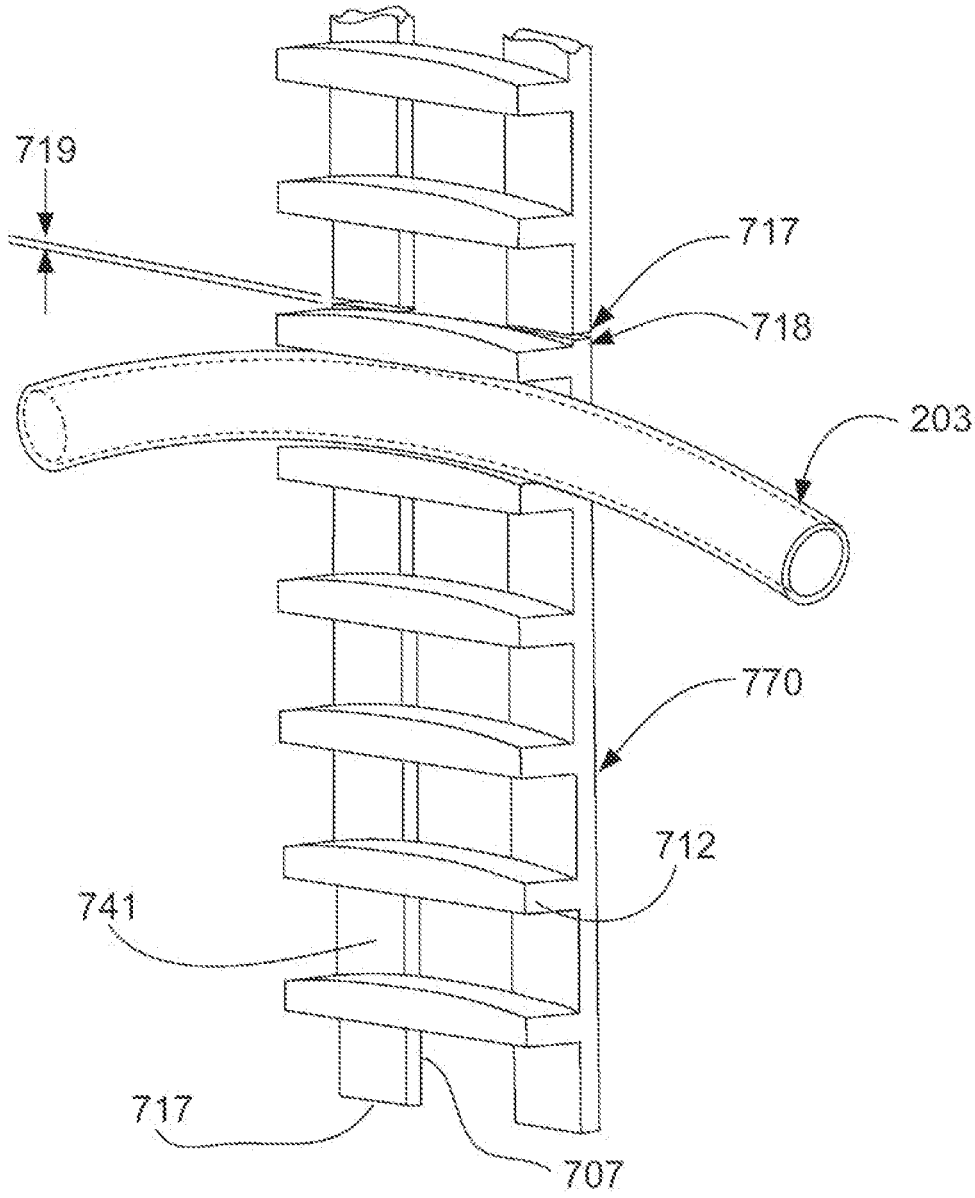
FIG. 5B is a partial perspective view of a nubbed support bar extension.

Nubbed ladder extensions 770, FIG. 5B, are comprised of two ladder rails 741 of appropriate length, with transverse nubs 712 at each inter-tube space along their length, on at least one side, similar to the rail 740 and nub 712 detail of the ladder portion of nubbed ladder-blocks 710 shown in FIG. 5A.

Ladder lengths for a particular tube layer are preferably arranged so that all inter-tube spaces within each tube column, down to the nub initiation radius 206, have nubs 712, either from nubbed ladder-block 710 or one or more nubbed ladder extensions 770.

Referring now to FIGS. 5B and 8, nubbed ladder extensions 770 are positioned on the associated fan bar 760 with nubs 712 engaging the respective tubes. Nubbed ladder extensions 770 are preferably not positively affixed to each other, to the nubbed ladder blocks 710, or to anything else. They are positioned entirely by engagement with their associated fan bars and tubes, and have no fasteners. Any ladder induced tube-to-tube interaction is thus within the span of the particular nubbed ladder extension 770.

The lower ends 717 of the rails 741 for ladder extensions 770 as well as those of the rails 740 of the ladder blocks 710 are generally positioned to avoid coincidence with the line of tube contact at the rails, thereby limiting wear at the rail corners. The upper ends 718 of the rails 741 of ladder extensions are preferably positioned to allow a small clearance 719 between the respective rail ends, such that ladder blocks 710 and ladder extensions 770 remain unconnected and independent of one another.

As shown in FIGS. 7 and 8, nubbed ladder-block fan bar array 780 is a full fan bar array having a plurality of flat fan bars 260, 760. As the ladder blocks 710 and ladder extensions 770 are separate from the array, nubbed ladder-block fan bar array 780 is flat and devoid of any out-of-plane features.

Figure 9A:
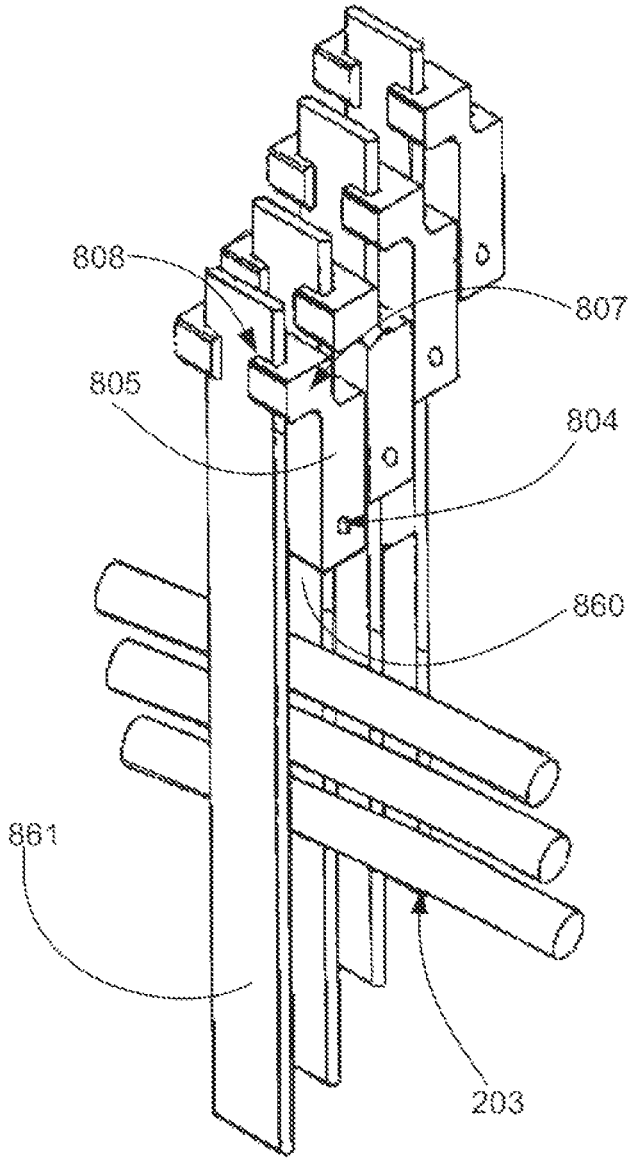
FIG. 9A is a partial perspective view of a spacer clip connector suitable for use in the present invention.
Figure 9B:
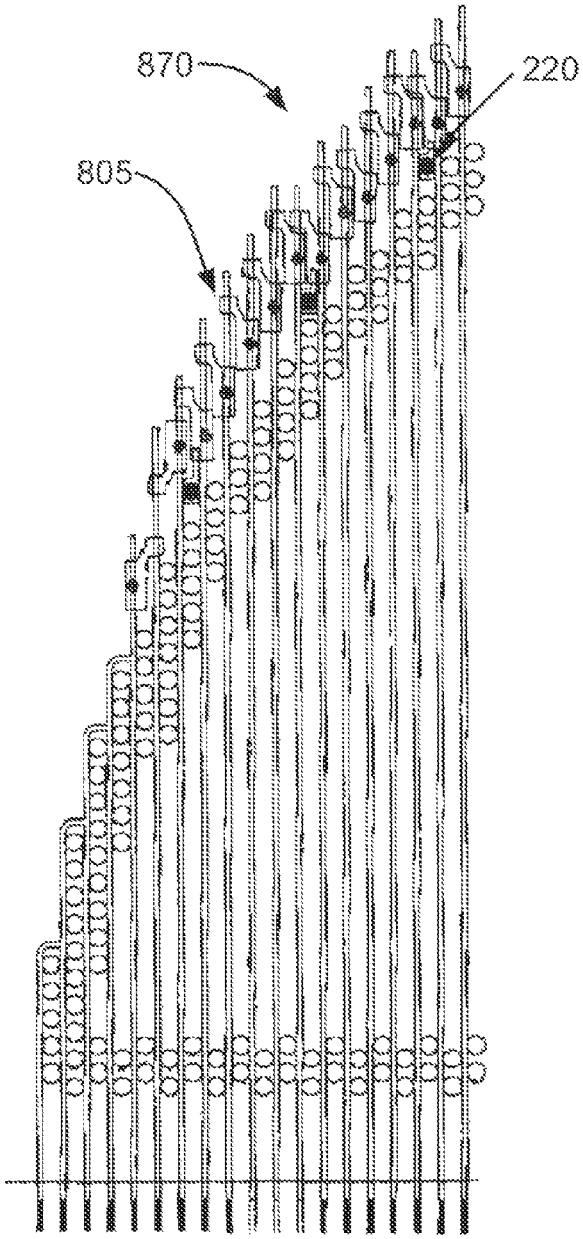
FIG. 9B is a sectional view of a spacer clip connector suitable for use in the present invention.
Figure 9C:
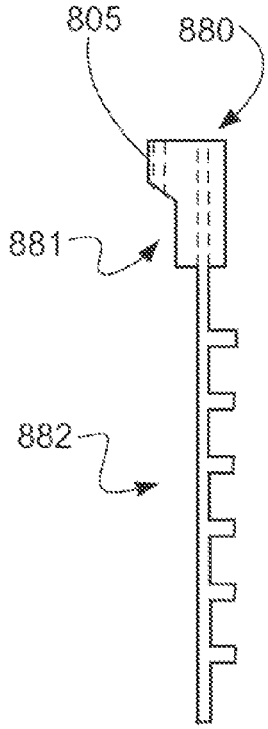
FIG. 9C is a sectional view of a spacer clip and ladder component

As shown in FIGS. 9A through 9C, a spacer clip end connector 805 may be used as an alternative to the spacer block 405 and stud 402 arrangement of spacer block assembly 400. Spacer clip 805 has a first slot 807 to engage a first fan bar 860 in its plane adjacent to tube layer 203. Spacer clip 805 is fixed to fan bar 860 by a "dog" or other gripping means 804 which engages a hole or notch near the bar end and prevents the spacer clip 805 from sliding endwise along the bar 860.

Spacer clip 805 also has a second slot 808 to engage fan bar 861 in the adjacent plane. Bar 861 is free to slide end-wise within its slot 808.

As shown in FIG. 9B, a spacer clip 805 is installed at the end of each fan bar 210, 260 so as to create a built-up arch 870 over the U-bend assembly at each fan bar location, similar to built-up arch assembly 270 comprised of spacer blocks 405.

The fan and U-bend layers are precisely spaced relative to their adjacent neighbors by the tolerance control of the spacer clips 805. The layers of fans and tubes are, however, free to slide over each other so that the U-bundle is free to sway without layer-to-layer constraint (as may occur with clamping of the bar ends). Such constraint may cause higher forces and stresses in a fan bar, etc. With spacer clip 805, the motion of the U-bends/fan layers is coordinated and moderated by the fan bars, but is not rigidly constrained. The resultant sway motions are greater that for a clamped arrangement, but local stresses due to rigid constraint are avoided.

Referring now to FIG. 9C, an alternative to spacer clips 805 is shown. Ladder clip 880 comprise clip sections 881, similar to clip 805, and ladder section 882 similar to ladder section 731 of ladder blocks 710.

Figure 6C:
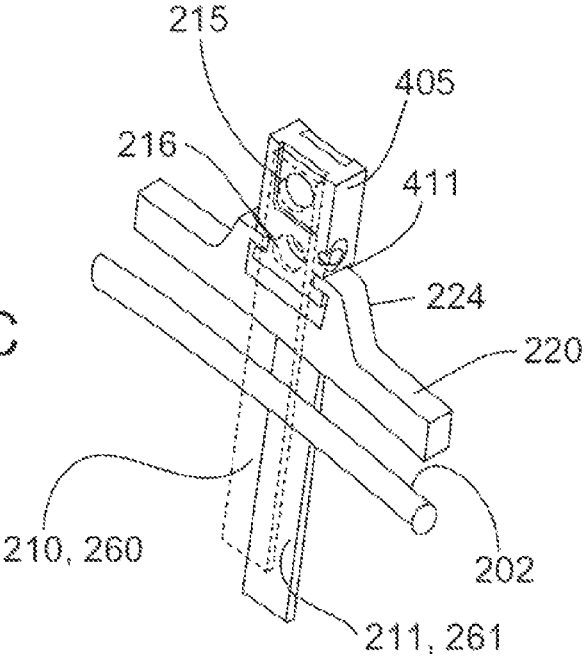
FIG. 6C is a partial perspective view of a spacer assembly and tie bar arrangement suitable for use in the present invention.
Figure 6D:
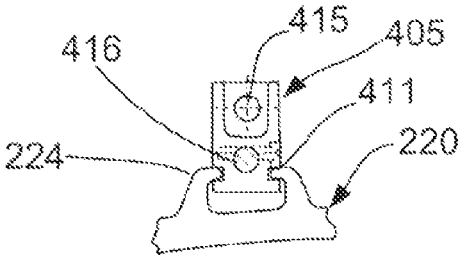
FIG. 6D is a partial sectional view of a spacer assembly and tie bar arrangement suitable for use in the present invention.
Figure 6E:
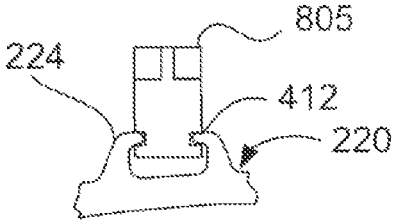
FIG. 6E is a partial sectional view of a clip assembly and tie bar arrangement.

Referring now to FIG. 6E, where clips 805 are used, tie bars 220 are connected to clips 805 by projections 224 on the tie bars 220 which engage with notches 412 on the clips in a manner similar to the engagement of tie bars 220 with spacer blocks 405.

Referring now to FIGS. 3, 6A through 6E, 7, 8, 9B, 11 and 12, tie bars 220 are preferably used to position the nubbed fan bar arrays 280, 780 in the in-plane direction and to keep the fan bars, e.g. 210, 260 and 760 from "splaying" apart (i.e. to keep the nubbed fan bar arrays 280 and 780 from spreading in the direction of the tube axes, and sliding down the two sides of the U-bend).

As shown in FIGS. 6A through 6E, tie bar 220 is an arcuate bar disposed in the plane of an associated tube layer or column 203 adjacent to, and spaced in parallel with, the extrados of the outermost U-tube 202. Tie bars 220 preferably have the same out-of-plane thickness 222 as the tube diameter (i.e. twice the length of tube cross-sectional radius 217, shown in FIG. 4) and lie entirely within the plane of the associated tube column or layer 203. In this way tie bars 220 are totally transparent to possible future inter-tube bundle access for service work in the field.

As shown in FIGS. 6C through 6E, the tie bar profile, having projections 224, engages notches 411, 412 in the spacer blocks 405, spacer clip 805, respectively, (or alternatively projections 711 of nubbed ladder-block 710), and is captured between successive fan bars, e.g. nubbed fan bar 210 and adjacent nubbed fan bar 211, or fan bar 260 and adjacent fan bar 261, so that no fasteners are required to keep tie bars 220 in place or to perform their function.

Preferably about five to eight pairs of tie bars 220 may be required, distributed across the U-bend support assembly 200.

Figure 10:
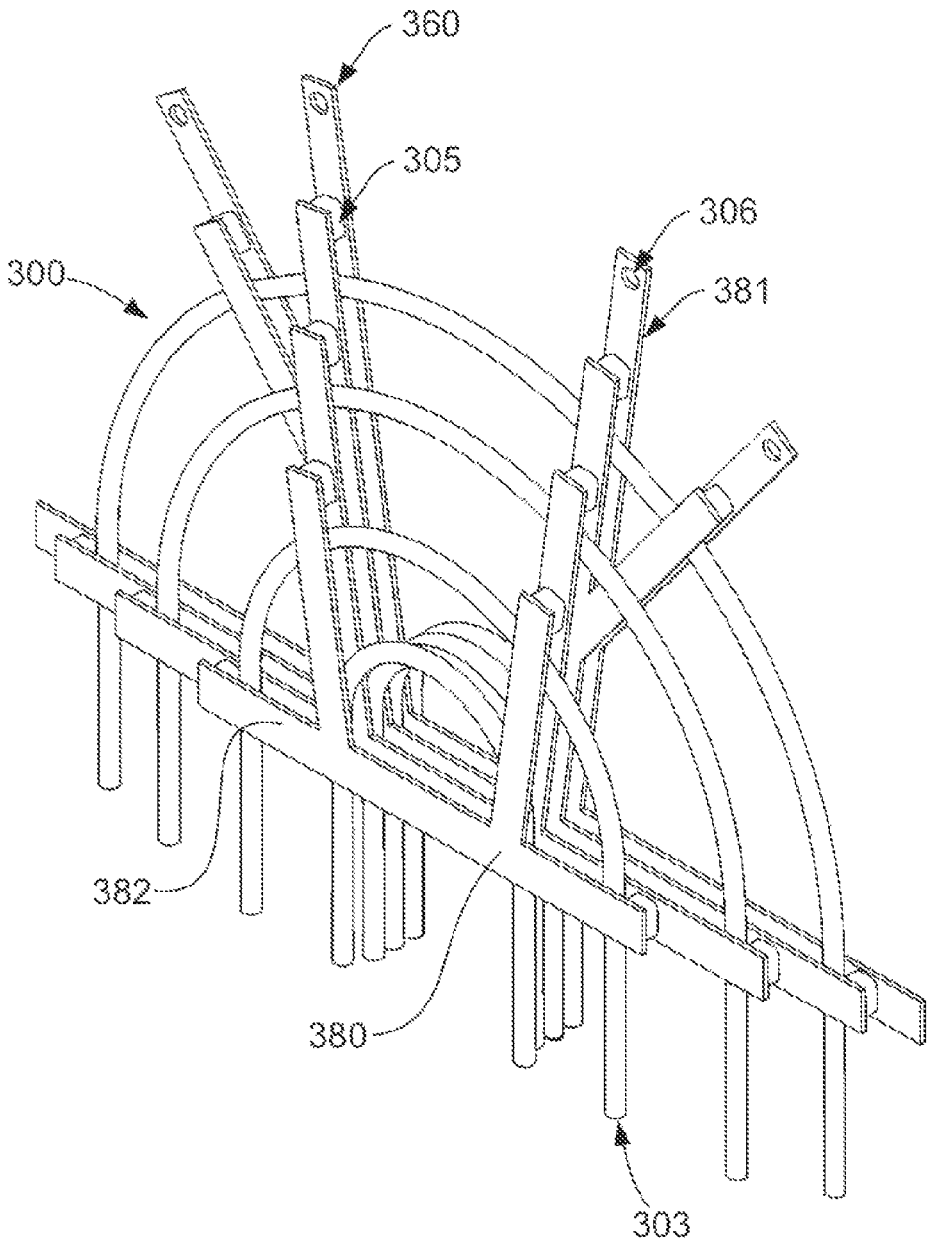
FIG. 10 is a perspective view of a saddle bar assembly suitable for use in the present invention.
Figure 11:
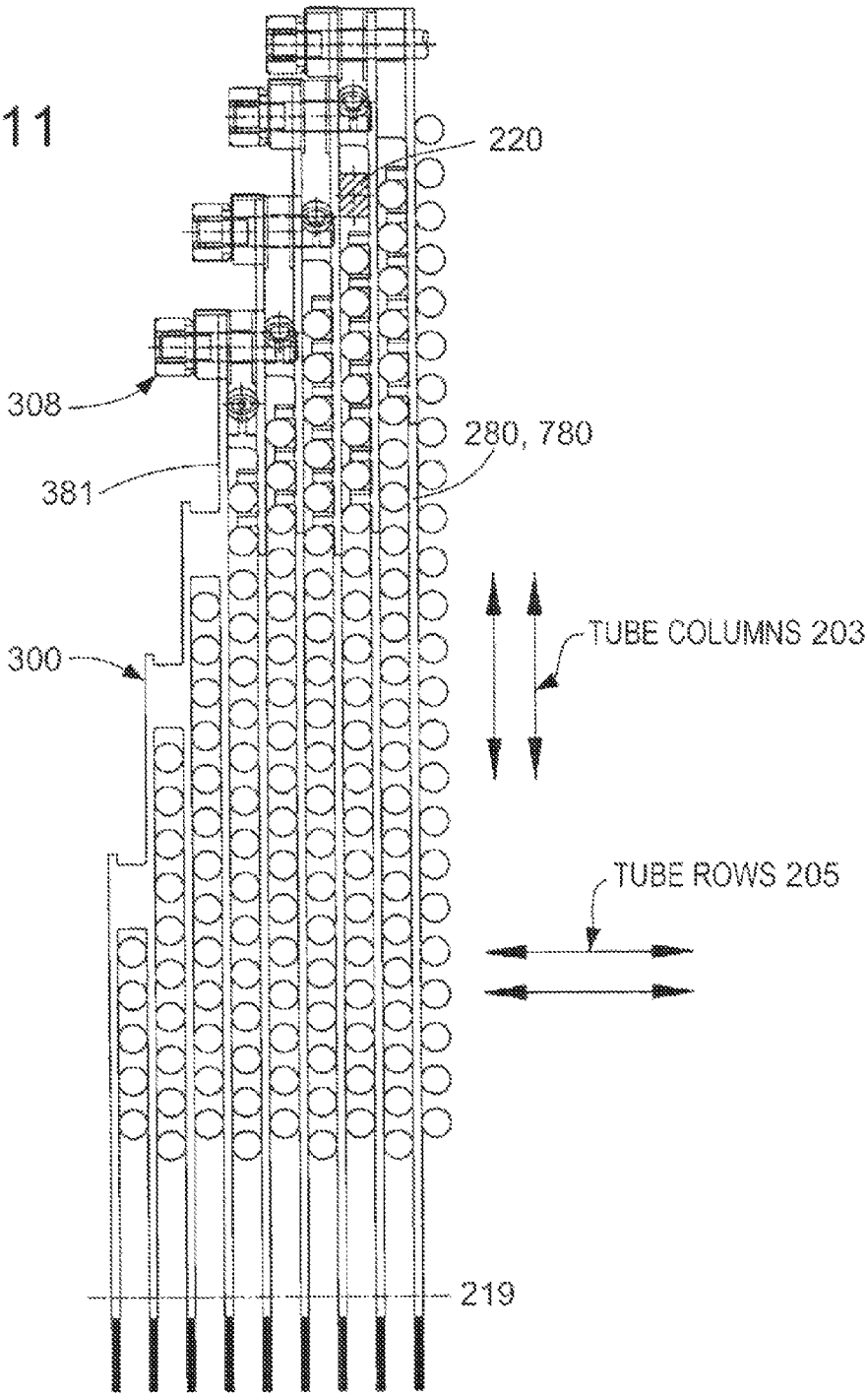
FIG. 11 is a cross sectional view of the saddle bar assembly taken along line 11-11 of FIG. 3.

FIGS. 10 and 11 show outer fan bar arrays 380 located on the outer edges of the tube bundle, adjacent layers of U-tubes comprised of U-tubes having a small bend radius of curvature. Outer fan bar arrays 380 are therefore not captured between tube layers and must be spaced and connected to other fan bar arrays, e.g. 280, 780 within the bundle. In the present invention, this is accomplished using saddle bar assemblies 300, which sit over the outer one, two or three tube layers of the tube bundle so as to properly position outermost fan bar arrays 380.

Saddle bar assembly 300 is comprised of fan bar arrays 380 (four shown in FIG. 10) made up of flat fan bars 360 and space pieces 305 arranged to allow the saddle bar assembly 300 to nest over the respective U-bend regions of outermost U-tubes 303, and to provide properly controlled support clearances at all tube contact locations. Fan arrays 380 are generally connected by welds at space pieces 305.

The innermost fan array 381 of the saddle bar assembly 300 is connected to the rest of the U-bend assembly by studs passing through fan bar stud holes 306 or other connection means, and joining the innermost fan array 381 to adjacent fan bar array 280 or nubbed ladder-block array 780. The weight of the saddle bar assembly 300 is thus transferred to adjacent arrays 280, 780 having nubs 212, thereby transferring the weight of saddle bar assembly 300 to the tube columns supporting nubbed fan bar arrays 280, 780, by means of studs 308 passing through stud holes 306.

Figure 12:
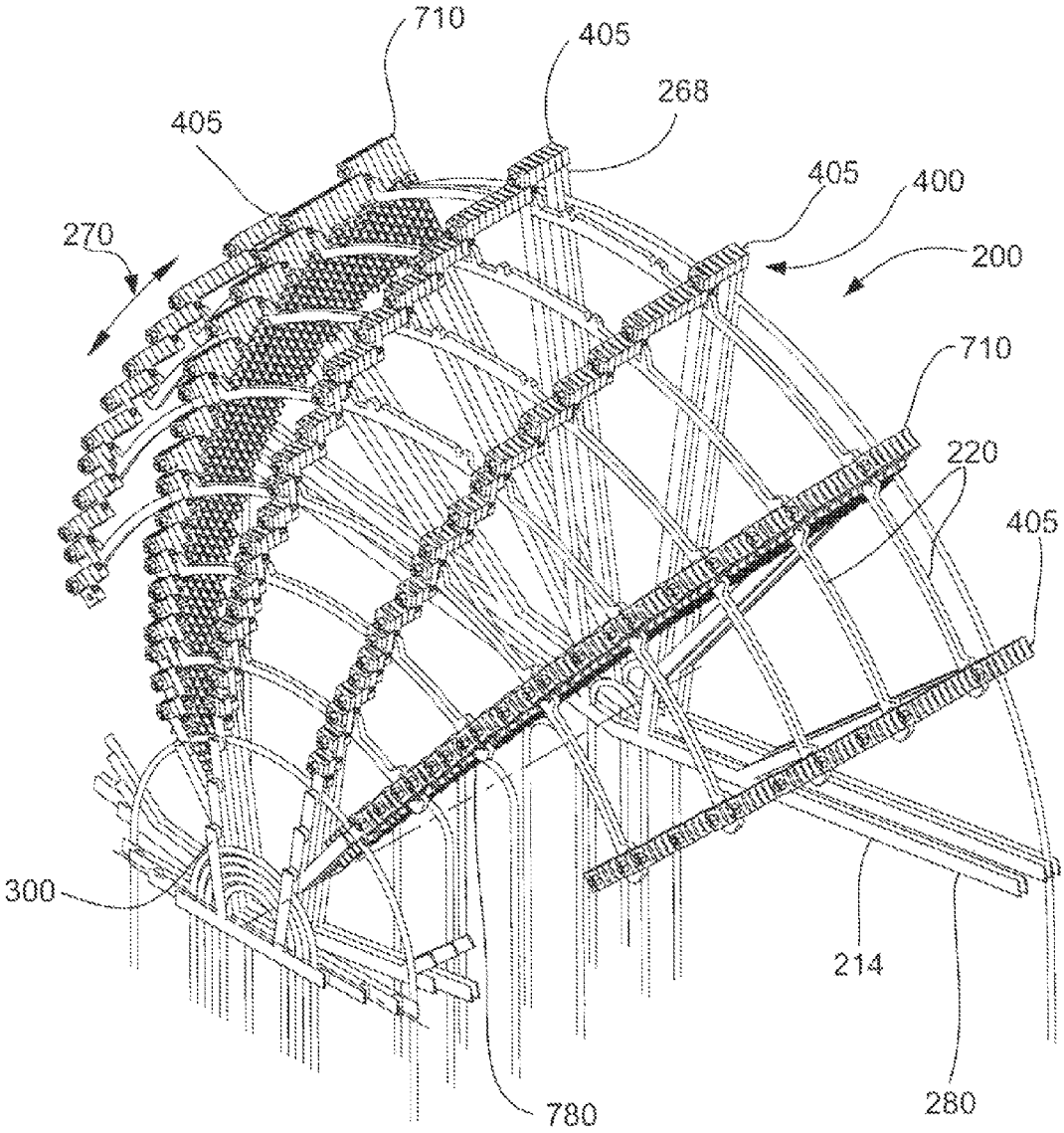
FIG. 12 is a partial perspective view of an improved U-bend support assembly according to the present invention.

FIG. 12 is a partial perspective view of a U-bend support assembly 200, where only selected U-tubes and nubbed fan bar arrays are shown for the sake of clarity. Support assembly 200 is made up of saddle bar assemblies 300, tie bars 220, fan bar arrays 280 or nubbed ladder-block arrays 780, and spacer block assemblies 400 having spacer blocks 405.

Referring now to FIG. 12, spacer blocks 405, and nubbed ladder-blocks 710, 780 form a plurality of built-up arch assemblies 270 over the top of the tube bundle at the locations of the fan bar ends such as 218, 268, 768. Tie bars 220, lying within associated tube planes or layers, in turn interconnect and control the position of built-up arch assemblies 270 and fan bar ends 218, 268, 768.

U-bend support assembly 200 is self-supporting to the tube layers through nubs 212 of the nubbed support bar arrays 280, 780, and is spaced in the in-plane direction by tie bars 220 and by spacer blocks 405, spacer clips 805, or ladder-blocks 710 in the out-of-plane direction. No additional external U-bend support structure is needed.

The individual tube and fan bar layers may optionally be made to slip relative to each other, so that the U-tubes and support assembly 200 as a whole may sway freely out-of-plane due to seismic or handling loads (including situations where the tube bundle is oriented horizontally) without excessive stress due to rigid local restraints. Optional free swaying condition may be achieved by limiting tension on studs 402 (FIG. 6B), or by use of clips 805 or ladder clips 881.

U-bend support assembly 200 (FIG. 3) is preferably used in nuclear U-tube steam generators where all U-tubes in all columns 203 have the same center of curvature 219, and thus have the same tangent point elevation 213. Such steam generators are free of cross-over tubes, and are also free of tube layers having expanded U-bend pitch with vertically offset centers of curvature.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

We claim:

1. A nubbed support bar array for supporting the U-bend region of U-tubes in a nuclear steam generator, the U-tubes having a predetermined cross-sectional radius, each U-tube having an intrados, an extrados and a U-tube radius of curvature, the U-tube having the largest radius of curvature defining a maximum bundle radius, the U-tubes being arranged in parallel tube layers with a nubbed support bar array associated with the each tube layer, the U-bend region of each tube layer extending radially about a center of curvature from an innermost tube to an outermost tube and further defining an in-plane direction and an out-of-plane direction, the nubbed support bar array comprising:

a plurality of first flat elongated bars, each of said first flat bars having an outer end and an inner end; and a plurality of nubbed support bars, each nubbed support bar comprising an elongated body having an outer end, an inner end connected to one of said plurality of first flat bars, first and second flat sides, and a plurality of nubs projecting in the out-of-plane direction from the first side;

wherein the nubs have a convex shaped tube contact face relatively parallel to the tube intrados of an adjacent U-tube and a flat shaped tube contact face relatively parallel to the tube extrados of an adjacent U-tube; and wherein there is spacing between the nubs to provide assembly clearance between the nubs and U-tubes.

2. The nubbed support bar array of claim 1, wherein the nubs project in the out-of-plane direction for a distance greater than the predetermined cross-sectional radius of the U-tubes.

3. The nubbed support bar array of claim 1, wherein each nub has a generally rectangular cross-section.

4. The nubbed support bar array of claim 1, further comprising a generally flat elongated bar connected to the inner ends of said plurality of first flat bars and extending across an entire associated tube layer.

5. The nubbed support bar array of claim 4, wherein the generally flat elongated bar is also connected to the inner ends of said nubbed support bars.

6. The nubbed support bar array of claim 4, wherein the generally flat elongated bar is comprised of a pair of flat elongated bars welded together.

7. The nubbed support bar array of claim 1, wherein the plurality of nubbed support bars extend radially, in the in-plane direction of an associated tube layer, from a point adjacent the outermost tube toward the center of curvature.

8. The nubbed support bar array of claim 1, wherein the plurality of nubs extend within an associated tube layer from a point adjacent the outermost tube to a point adjacent the U-tube having center of curvature equal to about 30% of the maximum bundle radius.

9. The nubbed support bar array of claim 1, wherein each of said nubbed support bars has a slot extending longitudinally from an inner end of the elongated body.

10. The nubbed support bar array of claim 1, wherein each of said nubbed support bars further comprises a flat bar disposed in a slot extending longitudinally from an inner end of the elongated body.

11. The nubbed support bar array of claim 1, further comprising first spacer means connected to said first flat bar outer ends, and second spacer means connected to said nubbed support bar outer ends, for spacing said nubbed support bar array in the out-of-plane direction.

12. The nubbed support bar array of claim 11, wherein the first and second spacer means have an out-of-plane thickness equal to a tube pitch between adjacent tube layers.

13. The nubbed support bar array of claim 11, wherein the second spacer means is integral with the each nubbed support bar outer end.

14. The nubbed support bar array of claim 11, wherein said first and second spacer means comprises spacer clip connectors, each spacer clip connector having first and second slots for slidably receiving first and second outer bar ends and gripping means to engage the first outer bar end.

15. The nubbed support bar array of claim 11, wherein said first and second spacer means comprise spacer blocks, each spacer block having a least one hole there through and a slot for receiving a flat bar therein.

16. The nubbed support bar array of claim 15, further comprising tie bar means for spacing said nubbed support bar array in the in-plane direction.

17. The nubbed support bar array of claim 16, wherein the spacer means has spacer notches disposed therein, and the tie bar means is spaced in parallel with the extrados of the outermost tube of an associated tube layer, the arcuate bar having projections thereon to engage the spacer notches.

18. The nubbed support bar array of claim 16, wherein the thickness of the tie bar means in the out-of-plane direction is about twice the cross-sectional radius of the U-tubes.

19. A nubbed support bar assembly for supporting the U-bend region of U-tubes in a nuclear steam generator, the U-tubes having a predetermined cross-sectional radius, each U-tube having an intrados, an extrados and a U-tube radius of curvature, one of the U-tubes having a largest U-tube radius of curvature, the U-tube having the largest U-tube radius of curvature defining a maximum bundle radius, the U-tubes being arranged in parallel tube layers, the U-bend region of each tube layer extending from a hot leg to a cold leg and extending radially about a center of curvature from an innermost tube to an outermost tube, each tube layer further defining an in-plane direction and an out-of-plane direction, the nubbed support bar assembly comprising:

a plurality of nubbed support bar arrays, each nubbed support bar array associated with an adjacent tube layer and comprising a plurality of first flat elongated bars having inner and outer first flat bar ends, a generally flat elongated bar connected to the inner ends of said plurality of first flat bars and extending across both the hot leg and the cold leg of the adjacent tube layer associated with the nubbed support bar array, a plurality of nubbed support bars, each nubbed support bar comprising an elongated body having a nubbed bar outer end, a nubbed bar inner end connected to one of said plurality of first flat bars, first and second flat sides, and a plurality of nubs projecting in the out-of-plane direction from the first side, each nub having a generally rectangular cross-section;

first spacer means connected to said first flat bar outer bar ends and nubbed support bar outer ends for spacing each nubbed support bar array in the out-of-plane direction; and a plurality of arcuate tie bars, each tie bar spaced in parallel with the extrados of the outermost tube of the adjacent tube layer associated with the nubbed support bar array and having an out-of-plane thickness about twice the cross-sectional radius of the U-tubes;

wherein the nubs have a convex shaped tube contact face relatively parallel to the tube intrados of an adjacent U-tube and a flat shaped tube contact face relatively parallel to the tube extrados of an adjacent U-tube; and wherein there is spacing between the nubs to provide assembly clearance between the nubs and U-tubes.

20. The nubbed support bar assembly of claim 19, wherein the nubs project in the out-of-plane direction for a distance greater than the predetermined cross-sectional radius of the U-tubes.

21. The nubbed support bar assembly of claim 19, wherein the plurality of nubs extend within an associated tube layer from a point adjacent the outermost U-tube to a point adjacent the U-tube having center of curvature equal to about 30% of the maximum bundle radius.

22. The nubbed support bar assembly of claim 19, wherein said nubbed support bars have a slot extending longitudinally from an inner end of the elongated body.

23. The nubbed support bar assembly of claim 19, wherein said nubbed support bars further comprise a flat bar disposed in a slot extending longitudinally from an inner end of the elongated body.

24. The nubbed support bar assembly of claim 19, wherein the first spacer means comprises a plurality of spacer blocks, each spacer block located between the first outer bar end in a first nubbed support bar array and a second outer bar end in an adjacent nubbed support bar array, each spacer block having a slot for receiving the first outer bar end therein, the spacer block and first and second outer bar ends each having a hole there through, the spacer block and adjacent outer bar ends being connected by a stud passing through said holes, and wherein the each spacer block has spacer notches and each tie bar has projections thereon to engage the spacer notches.

25. The nubbed support bar assembly of claim 19, wherein the first spacer means comprises spacer clip connectors, each spacer clip connector located between the first outer bar end of a first nubbed support bar array and a second outer bar end of an adjacent nubbed support bar array, the first outer bar end having one of an opening and a notch therein, the clip connecter having gripping means to engage the one of the opening and a notch and first and second slots for slidably receiving the first and second outer bar ends.

26. The nubbed support bar assembly of claim 19, further comprising a saddle bar assembly connected to an adjacent nubbed support bar array, the saddle bar assembly having a plurality of outer fan bar arrays, each outer fan bar array having a plurality of second flat elongated bars with inner and outer ends, a generally flat elongated bar connected to the inner ends of said plurality of second flat bars and extending across both the hot leg and the cold leg of the associated tube layer, and second spacer means connected to the outer ends.

27. The nubbed support bar assembly of claim 19, wherein the first spacer means comprises a ladder clip.

* * * * *